US010099902B1

(12) United States Patent
Dixon et al.

(10) Patent No.: US 10,099,902 B1
(45) Date of Patent: Oct. 16, 2018

(54) ARTICULATING RAIL FOR MULTIDIRECTIONAL MOVEMENT OF SUSPENDED LOAD

(71) Applicant: The Boeing Company, Chicago, IL (US)

(72) Inventors: Robert D. Dixon, Everett, WA (US); Kevin L. Salt, Mount Vernon, WA (US); Jeffrey A. Zornes, Everett, WA (US); David A. Haverberg, Renton, WA (US); Michael D. Hinckley, Seattle, WA (US); Chris Carlson, Seattle, WA (US); Craig B. Morgan, Edmonds, WA (US)

(73) Assignee: THE BOEING COMPANY, Chicago, IL (US)

( * ) Notice: Subject to any disclaimer, the term of this patent is extended or adjusted under 35 U.S.C. 154(b) by 351 days.

(21) Appl. No.: 14/877,166

(22) Filed: Oct. 7, 2015

(51) Int. Cl.

| | |
|---|---|
| ***B66C 7/08*** | (2006.01) |
| ***B61B 3/00*** | (2006.01) |
| ***B61B 12/02*** | (2006.01) |
| ***B66C 7/04*** | (2006.01) |

(52) U.S. Cl.
CPC ..... *B66C 7/08* (2013.01); *B61B 3/00* (2013.01); *B61B 12/02* (2013.01); *B66C 7/04* (2013.01)

(58) Field of Classification Search
CPC .... B66C 7/04; B66C 7/08; B61B 3/00; B61B 12/02
See application file for complete search history.

(56) References Cited

U.S. PATENT DOCUMENTS 3,880,087 A * 4/1975 Pamer ..... B61B 13/04 104/123
4,062,519 A * 12/1977 Jacobs ..... A63C 19/06 160/331
4,492,168 A * 1/1985 Cellai ..... B61B 12/02 105/153
5,038,900 A * 8/1991 Durant ..... D01H 9/005 198/465.4
5,231,932 A * 8/1993 Enderlein ..... B65G 19/025 104/162
6,138,574 A * 10/2000 Zaguroli, Jr. ..... E01B 25/24 104/106
6,269,904 B1 * 8/2001 Morhaus ..... A62B 35/0087 182/36
6,345,578 B1 * 2/2002 Pabst ..... B61B 12/02 104/112
6,360,669 B1 * 3/2002 Albrich ..... B61B 3/00 104/173.1
6,543,366 B2 * 4/2003 Pabst ..... B61B 12/02 104/173.2

(Continued)

*Primary Examiner* — Saul Rodriguez
*Assistant Examiner* — Ashley K Romano
(74) *Attorney, Agent, or Firm* — MH2 Technology Law Group LLP

(57) ABSTRACT

A rail fixture that may include a plurality of track sections suspending a plurality of rail sections. The rail fixture may further include a traveler that traverses across one of the track sections, and a trolley that traverses across the plurality of rail sections. The rail fixture may further include a motorized winch assembly that may be used to lift a load to be moved toward the rail sections. The rail fixture may be used to move a load from a first location to a second location, for example, through an enclosed space having little clearance.

20 Claims, 11 Drawing Sheets

(56) References Cited

U.S. PATENT DOCUMENTS

| | | | | |
|---|---|---|---|---|
| 6,745,891 | B2 * | 6/2004 | Walter | B61B 10/025 104/172.4 |
| 6,758,325 | B2 * | 7/2004 | Greeley | B61B 3/00 198/465.4 |
| 8,172,073 | B2 * | 5/2012 | Luger | B61B 12/06 104/179 |
| 9,139,206 | B2 * | 9/2015 | Quattlebaum | B61B 3/02 |
| 9,475,503 | B2 * | 10/2016 | Fessler | B61B 7/02 |
| 2008/0229967 | A1 * | 9/2008 | Lins | A63G 21/22 104/173.1 |
| 2009/0293757 | A1 * | 12/2009 | Bischofberger | B61B 12/02 104/123 |
| 2010/0107919 | A1 * | 5/2010 | Perakis | A63G 21/22 104/112 |
| 2010/0288155 | A1 * | 11/2010 | Chepurny | A61G 7/1042 104/89 |

* cited by examiner

ARTICULATING RAIL FOR MULTIDIRECTIONAL MOVEMENT OF SUSPENDED LOAD

TECHNICAL FIELD

The present teachings relate to the field of industrial manufacturing such as the manufacture of aircraft and, more particularly, to a system that is sufficient to transport heavy objects through enclosed or tight spaces.

BACKGROUND

Industrial manufacturing of vehicles such as aircraft or other manufactured structures often requires moving heavy loads through enclosed or tight spaces. For example, after an initial assembly of an aircraft airframe, bulky and/or heavy articles or loads such as electrical power distribution systems (i.e., power panels) or other items or objects must be moved through the airframe to their final location. These loads must often be carried manually by assembly personnel, for example, because the floor of the aircraft is uneven and transporting the item with a dolly or other transportation aid is not possible.

Additionally, heavy objects such as power panels may require two or more assembly personnel so that the weight is distributed across workers, and a coordinated effort within the tight spaces of the aircraft and around corners can be difficult. Damage of aircraft structures is exceedingly common and requires repairs to be performed, which is time consuming and expensive. Further, injury to assembly personnel from tripping and carrying awkward, heavy loads through confined spaces can occur. In tight spaces such as aircraft airframes, often there is not sufficient vertical space to locate a motor and winch assembly above a top hook, cable and load, and the load cannot be lifted high enough or the system cannot be used in a tight space. Also, control of a crane winch is often difficult because the motor is placed at a location that is distant from the operator and the lifted object. Systems for moving a heavy load may be difficult and time-consuming to install and uninstall.

A structure and method that allows for simplified transportation of an object through tight spaces, such as a power panel through an airframe, that has a fast setup time would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a rail fixture can include a plurality of rail sections including a first rail section, a second rail section, and at least a third rail section, at least two rail hangers configured to suspend the plurality of rail sections from a rail support structure, and at least one trolley including at least three roller wheels and a load support configured to support a load to be moved using the rail fixture. The trolley may be configured to traverse the plurality of rail sections, the first rail section and the second rail section may be connected together and configured to articulate with each other and to form a varying first angle during movement of the load to be moved, and the second rail section and the third rail section may be connected together and configured to articulate with each other and to form a varying second angle during movement of the load to be moved. The rail fixture may further include a first articulating joint connecting the first rail section and the second rail section together, and a first seam at an interface of the first rail section and the second rail section at the first articulating joint, as well as a second articulating joint connecting the second rail section and the third rail section together, and a second seam at an interface of the second rail section and the third rail section at the second articulating joint, wherein a centerline of each roller wheel is configured to roll across the first seam and the second seam. The first rail section and the second rail section may be configured such that the first angle decreases during an increase in the second angle, and the first angle increases during a decrease in the second angle.

In an embodiment, the rail fixture may include at least one track section and at least two travelers attached to the at least two rail hangers, wherein the at least two travelers are configured to traverse the at least one track section as the first rail section and the second rail section articulate with each other and as the second rail section and the third rail section articulate with each other. Each rail hanger may further include a hanger frame having an opening therein and a carabiner rotatably attached to the hanger frame. The rail fixture may further include at least one stopper plate including a first leg and a second leg, wherein the second leg is shorter than the first leg, the stopper plate is rotatably attached to the carabiner, the stopper includes a first position that allows at least one of the travelers to be positioned on one of the track sections, and the stopper includes a second position that blocks one of the track sections to prevent at least one of the travelers from extending past an end of the track section.

In an embodiment, the track section may include a first lip and a second lip, and each traveler may include a first set of wheels that engage the first lip during movement of the load to be moved and a second set of wheels that engage the second lip during movement of the load to be moved. The at least one trolley may be configured to engage at least the second rail section as the first rail section and the second rail section articulate with each other and as the second rail section and the third rail section articulate with each other.

In an embodiment, the rail fixture may further include a first pin that connects the first rail section and the second rail section together, wherein the first rail section and the second rail section are configured to articulate by swiveling on the first pin, and a second pin that connects the second rail section and the third rail section together, wherein the second rail section and the third rail section are configured to articulate by swiveling on the second pin. The rail fixture may further include a strap attached to the load support and a motor attached to the strap, wherein the strap is configured to be attached to a load to be moved and the motor is configured move along the strap to lift the load to be moved during operation of the motor. The rail fixture may further include a load to be moved attached to the strap, wherein the rail fixture is configured to lift the load toward the plurality of rail sections during operation of the motor.

In another embodiment, a rail fixture can include a corner assembly having a first track section and a second track section, wherein the first track section intersects the second track section at an intersection. The corner assembly may include a first traveler configured to traverse the first track section and a second traveler configured to traverse the second track section, a first rail section connected to the first traveler by a first rail hanger, a second rail section connected at a first articulating joint to the first rail section, and a third rail section connected to the second rail section at a second articulating joint and further connected to the second traveler by a second rail hanger. The rail fixture may further include a trolley configured to traverse the first rail section, the second rail section, and the third rail section. The first traveler may be configured to be in a first position near the intersection when the first rail section is straight with the second rail section, and when the second rail section forms a 90° angle with the third rail section, while the second traveler may be configured to be in a second position away from the intersection when the first rail section is straight with the second rail section, and when the second rail section forms a 90° angle with the third rail section, where the second position is further away from the intersection than the first position. Further, the first traveler may be configured to be in a third position away the intersection when the first rail section forms a 90° angle with the second rail section, and when the second rail section is straight with the third rail section, while the second traveler may be configured to be in a fourth position near the intersection when the first rail section forms a 90° angle with the second rail section, and when the second rail section is straight with the third rail section, where the fourth position is closer to the intersection than the third position. In an embodiment, the first rail section and the second rail section may be attached at the first articulating joint, and the first articulating joint may be configured such that the first rail section can swivel on the second rail section. Further, the second rail section and the third rail section may be attached at the second articulating joint, and the second articulating joint may be configured such that the second rail section can swivel on the third rail section.

In another embodiment, a method for moving a load along a plurality of rail sections of a rail fixture can include attaching a load to be moved to a trolley, engaging a first rail section with the trolley, and rolling the trolley along the first rail section, off the first rail section, and onto a second rail section such that the trolley engages the second rail section, wherein the second rail section is attached to, and configured to articulate with, the first rail section. Further, with the trolley engaging the second rail section, the first rail section may be articulated with the second rail section such that a first angle formed by the first rail section and the second rail section decreases. Additionally, during the articulating of the first rail section with the second rail section, the method can include articulating the second rail section with a third rail section that is attached to, and configured to articulate with, the second rail section such that an a second angle formed by the second rail section and the third rail section increases.

The method may further include rolling the trolley along the second rail section, off of the second rail section, and onto the third rail section, such that the trolley engages the third rail section subsequent to the articulating of the first rail section with the second rail section and subsequent to the articulating of the second rail section with the third rail section. The first angle may be from 140° to 180° prior to articulating the first rail section and the second rail section, and the method may further include decreasing the first angle to from 90° to 130° during the articulating of the first rail section with the second rail section. The second angle may be from 90° to 130° prior to articulating the second rail section and the third rail section, and the method may further include increasing the second angle to from 140° to 180° during the articulating of the second rail section with the third rail section. The first angle may be decreased from 180° to 90° during the articulating of the first rail section with the second rail section, and the second angle may be increased from 90° to 180° during the articulating of the second rail section with the third rail section. During the articulating of the first rail section with the second rail section, a first traveler that is attached to the first rail section may be rolled along a first track section of a track and, during the articulating of the second rail section with the third rail section, a second traveler that is attached to the third rail section may be rolled along a second track section, wherein the first track section forms an angle of 90° with the second track section.

In an embodiment, the load to be moved may be attached to a motor, wherein the motor is attached to the trolley with a strap. The motor may be operated to lift the load to be moved along the strap and toward the plurality of rail sections. In an embodiment, operating the motor may include operating an electric drill.

BRIEF DESCRIPTION OF THE DRAWINGS

The accompanying drawings, which are incorporated in, and constitute a part of this specification, illustrate embodiments of the present teachings and, together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As described above, transporting a heavy object such as a power panel through an aircraft airframe is difficult, often results in damage to the aircraft and/or power panel, is typically completed manually by manufacturing personnel, and may result in injury to assembly personnel. Rolling the article or load across the floor of the aircraft using transportation equipment such as a dolly is not possible due to the uneven surface of the floor. Some specifications require that an employee may lift a maximum weight of less than 40 pounds, while a heavy load such as a power panel may weigh as much as 400 pounds, and transporting the load thereby requires a coordinated effort by several employees through tight spaces and uneven surfaces. Embodiments of the present disclosure may provide rail fixture that can be used to transport heavy objects through tight spaces. While the description below describes the present disclosure with respect to the transport of a power panel through an aircraft airframe, it will be understood that the transport of other objects, regardless of weight or bulk, through spaces other than an aircraft airframe is also contemplated.

Figure 1:
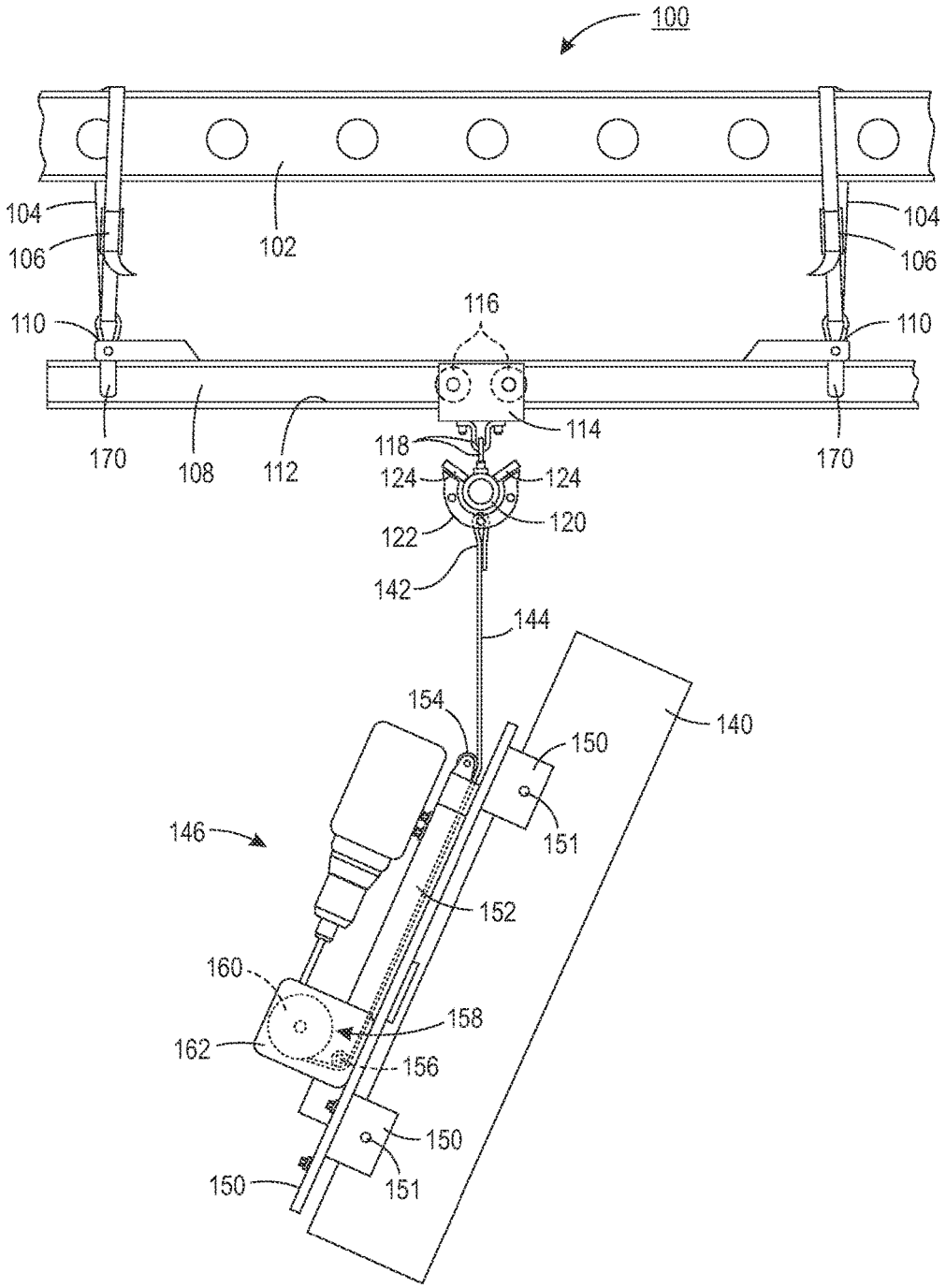
FIG. 1 is an end view.
Figure 2:
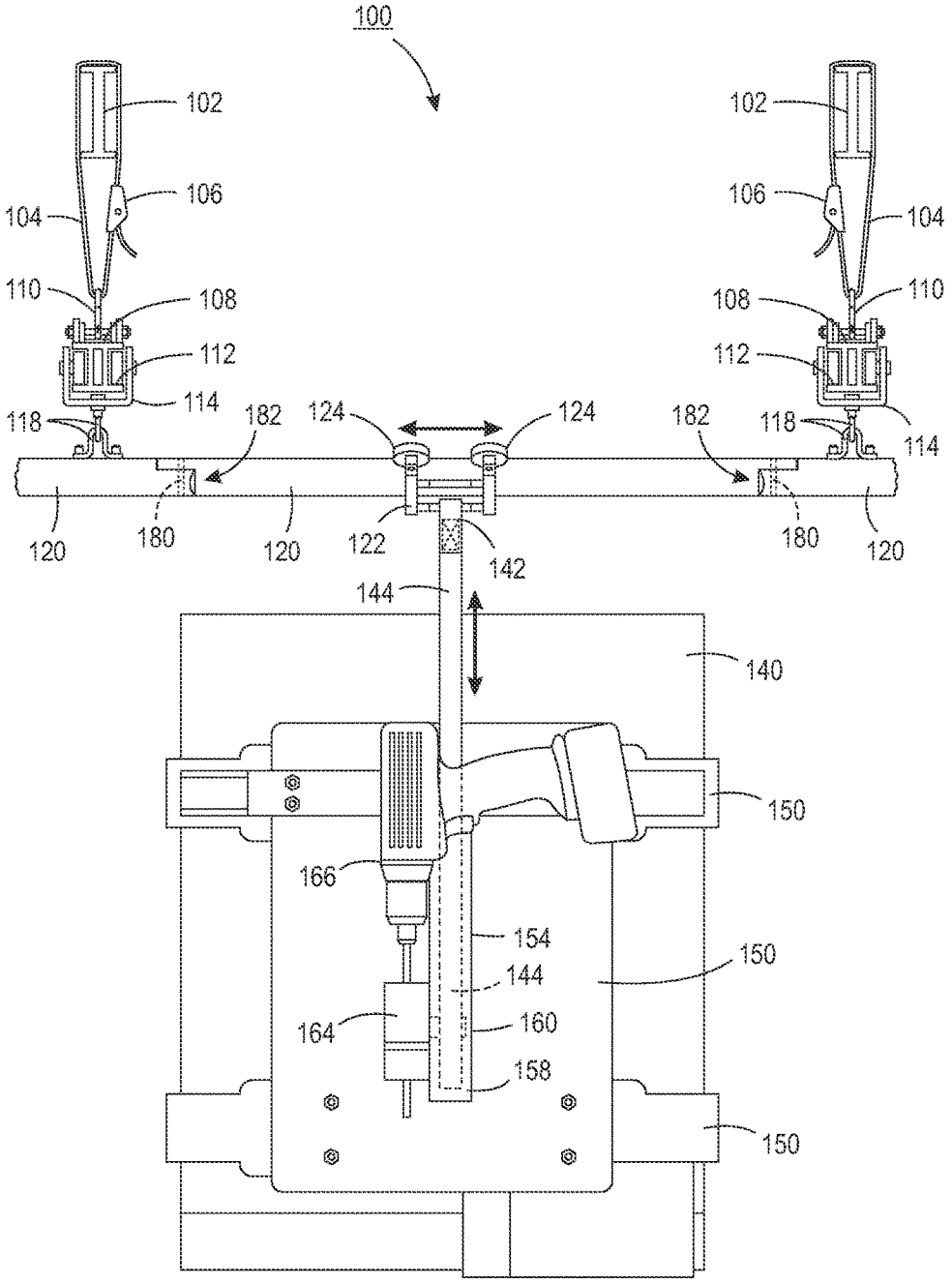
FIG. 2 is a side view, depicting a rail fixture that may be used to move a load from a first location to a second location in accordance with an embodiment of the present teachings.

FIG. 1 is an end view, and FIG. 2 is a side view, of a rail fixture 100 in accordance with an embodiment of the present teachings. While FIGS. 1 and 2 are schematic depictions of one exemplary embodiment of the present teachings, it will be understood that a rail fixture according to the present teachings may include other structures that are not depicted for simplicity, while other depicted structures may be removed or modified. The rail fixture 100 may be attached to an airframe 102. The rail fixture 100 can include two or more pliant hangers 104 such as straps or cables that may be positioned around the airframe 102 and secured with, for example, a cam buckle 106. The pliant hangers 104 may be attached to a track section 108 using a track hanger 110 such as a carabiner or other track hanger 110, and may include other subassemblies. A rail fixture 100 will typically include a plurality of track sections 108 as described and depicted herein.

The track section 108 may include a pair of horizontal shelves or lips 112 that extend laterally from each side along a length of the track section 108. The shelves 112 can be configured to support one or more travelers 114. The travelers 114 may include a set of traveler wheel assemblies 116 that engage, and are supported by, the shelves 112 of the track section 108, such that the travelers 114 freely traverse along a length of the track section 108 by rolling along the shelves 112. The traveler wheel assemblies 116 can include various subassemblies such as wheels, bearings, axles, etc. In an embodiment, each traveler 114 can include four traveler wheel assemblies 116, with two traveler wheel assemblies 116 positioned on each side of the track section 108. It will be understood that the wheel assemblies 114 and shelves 112 are merely one example of a mechanical assembly that allows the traveler 112 to traverse the length of the track section 108, and other mechanical assemblies are contemplated.

FIGS. 1 and 2 further depict a rail hanger 118 that attaches the traveler 114 to a rail section 120. The rail hanger 118 can include a pair of interlocking arcuate fittings as depicted, where a first arcuate fitting is attached to a surface of the traveler 114 and a second arcuate fitting is attached to a surface of the rail section 120. Other rail hanger designs are contemplated.

The rail section 120 can be configured to support one or more trolleys 122. The trolley 122 may include a set of trolley wheel assemblies 124 that engage, and are supported by, the rail section 120, such that the trolley 122 freely traverses along a length of the rail section 120 by rolling along the rail section 120. The trolley wheel assemblies 124 can include various subassemblies such as wheels, bearings, axles, etc. In an embodiment, each trolley 122 can include at least three trolley wheel assemblies 124, where at least two trolley wheel assemblies 124 are positioned on one side of the rail section 120 and at least one trolley wheel assembly 124 positioned on the other side of the rail section 120. The set of trolley wheels may further include two wheel assemblies 124 on each side of the rail section 120, or three or more wheel assemblies 124 on each side of the rail section. As the number of trolley wheel assemblies 124 increases, the trolley 122 may support a heavier weight. It will be understood that the trolley wheel assemblies 124 are merely one example of a mechanical assembly that allows the trolley 122 to traverse the length of the rail section 120, and other mechanical assemblies are contemplated.

A load 140, for example, a power panel, that is to be moved from a first location to a second location within an airframe 102 may be attached to the trolley 122 using a load hanger 142. The load hanger 142 may include a flexible strap 144 that is secured around a portion of the trolley 122, thereby supporting the load 140 and suspending the load 140 in the air and off the floor of the airframe 102.

FIGS. 1 and 2 further depict an optional motorized winch assembly 146 for lifting the load 140 toward the rail fixture 100 such that the load 140 is suspended in the air and off the floor of the airframe 102 prior to moving the load 140 from a first location to a second location. The winch assembly can include a strongback 150 removably secured to the load 140 with one or more fasteners 151 such as pins or bolts placed through the strongback 150 and into openings within a housing of the load 140. The winch assembly 146 can further include a hollow tube 152 that attaches to the strongback 150, a first roller 154 attached to the tube 152 at a tube opening at a first end of the tube 152, a second roller 156 within an interior of the tube 152, and a slot 158 that extends through a wall of the tube 152 proximate the second roller 156. The winch assembly can further include a take-up reel 160 that may be attached to the tube 152 by a frame 162, a gearbox 164 in mechanical communication with the take-up reel 160, and a motor 166 in mechanical communication with the gearbox 164. In this embodiment, the motor 166 is supplied by a battery-powered electric drill, although other DC or AC motors are contemplated.

In one embodiment to install the rail fixture 100, assembly personnel may set up a number of track sections 108 through the airframe 102, from the second (ending) location to the first (starting) location. Each track section 108 may be attached using one or more pliant hangers 104, for example, one or more straps 104 secured around the airframe 102 with cam buckles 106. The number of track sections 108 required may depend, at least in part, on the weight of the load 140 being moved and the number of turns, such as 90° turns, that must be made through the aircraft while moving the load from the first location to the second location.

As depicted in FIGS. 1 and 2, various rail sections 120 may include a traveler 114 that is secured, for example, to one end of the rail section 120 with a rail hanger 118. In one type of rail section 120, each end of the rail section may include a different traveler 114 attached thereto. In another type of rail section 120, only one end of the rail section 120 may have a traveler attached thereto. In yet another type of rail section 120, no traveler is attached, as described below. Once a track section 108 is installed, a rail section 120 can be attached to the track section 108 by rolling the traveler 114 that is attached to the end of the rail section 120 over an end of the track section 108. To prevent the traveler 114 from rolling off the track section 108, a stopper 170 may be placed near the end of the track section 108 that blocks the traveler 114 from rolling off the track section 108. The stopper 170 may be a fitted cap that fits over the end of the track, a pin or other structure that fits through a hole in the track, a stopper as described below with reference to FIGS. 10 and 11, or another type of stopper.

Each rail section 120 can be removably connected to another rail section 120 at an articulated joint that uses a pin 180 which extends from tongue at one end of one rail section 120 into a hole 182 through a tongue of another rail section 120. The pin 180 extends downward through the hole 182, and thus gravity and the weight of the load 140 as it passes across the joint between two rail sections 120 is sufficient to prevent the two rail sections from separating.

After the plurality of track sections 108 and the plurality of rail sections 120 are installed, the trolley 122 can be rolled over an end of the first rail section 120 at the first location, and the load hanger 142 can be attached to the trolley 122.

In this embodiment, the load 140 includes a power panel 140. To move the power panel 140, the strongback 150 and the motorized winch assembly 146 is attached to the power panel 140. The flexible strap 144 is fed through the opening at the end of the hollow tube 152 such that it physically contacts the first roller 154, fed through the hollow tube 152, then positioned around the second roller 156 and through the slot 158 in the hollow tube. The end of the flexible strap 144 is then attached to the take-up reel 160. The motor 166, which may be conveniently supplied using the battery-powered electric drill as depicted, is engaged to operate the gearbox 164 which, in turn, rotates the take-up reel 160. The strap 144 is reeled in on the take-up reel 160, which lifts the strongback 150 to which the winch assembly 146 is attached, along with the power panel 140, off the floor of the airframe 102 and toward the rail fixture 100, thereby suspending the power panel 140 in the air. The winch assembly 146 is described in more detail below with reference to FIG. 12.

Subsequently, the trolley 122 can be rolled along the plurality of rails 120 from the first location to the second location. During relocation of the load 140, the travelers 114 can rolled along the track sections 108 and, because the rail fixture 100 is not rigidly attached to the airframe 102, the rail fixture 100 is able to be repositioned to move the load 140 laterally around walls and other structures of the airframe 102. Because the travelers 114 and the trolley 122 are open at the top, they may respectively roll past the track hangers 110 and the rail hangers 118.

Even though the rail fixture 100 is not rigidly attached to the airframe 102 and has a degree of movement available during transport of the load 140, rolling the trolley 122 around a bend or corner such as a 90° corner can prove difficult. In attempting to traverse around a corner, an arcuate corner rail section that has an excessively short radius makes it difficult or impossible to roll the trolley 122 freely around the corner. Further, an arcuate corner rail section may not be easily supported around the entire radius. A particularly heavy load such as a power panel may cause an arcuate corner rail section to droop or sag such that the power panel physically contacts the floor of the airframe 102 without readjustment of the strap or hanger.

Figure 3:
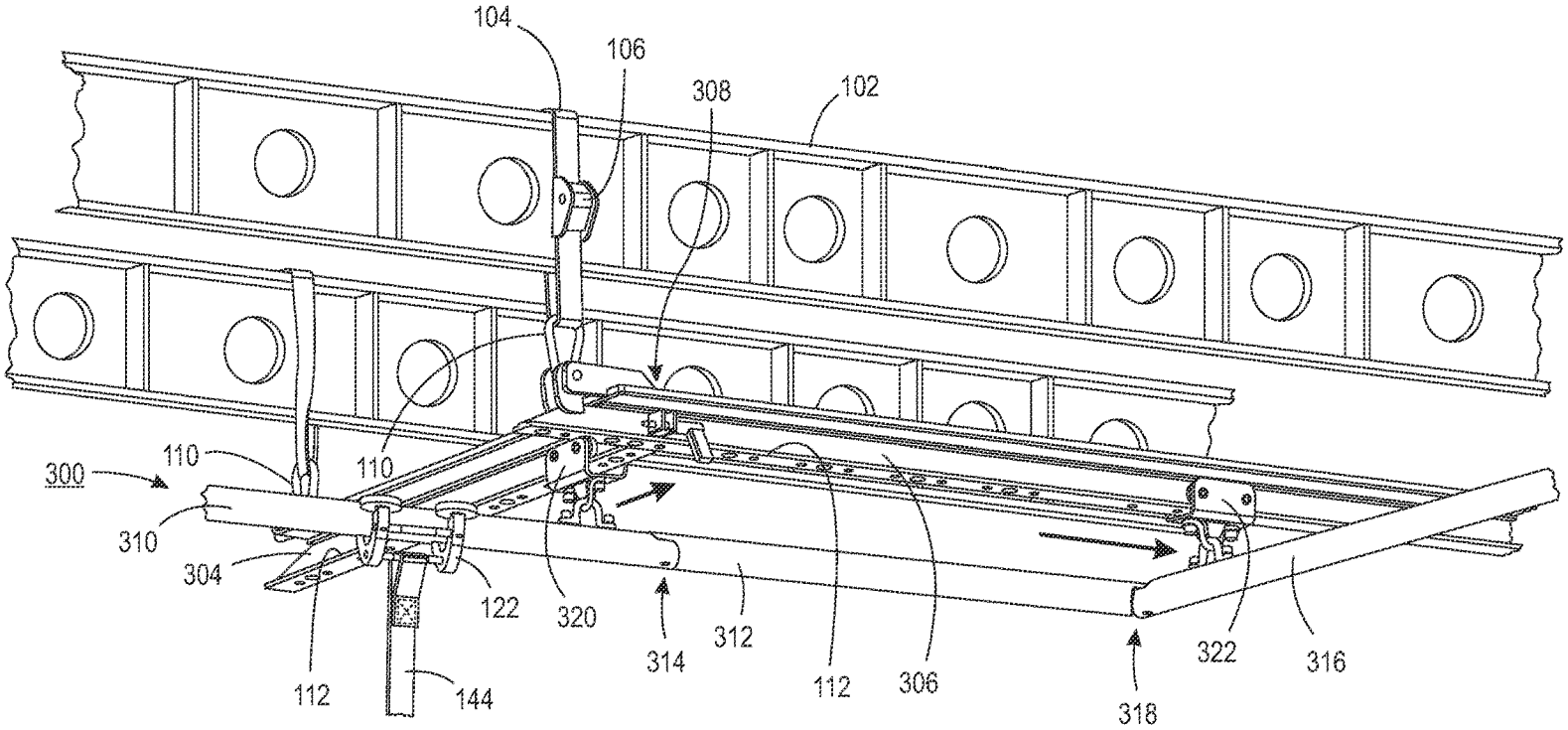
FIGS. 3-6 are perspective depictions of a rail fixture while moving a load from a first location to a second location in accordance with an embodiment of the present teachings.
Figure 4:
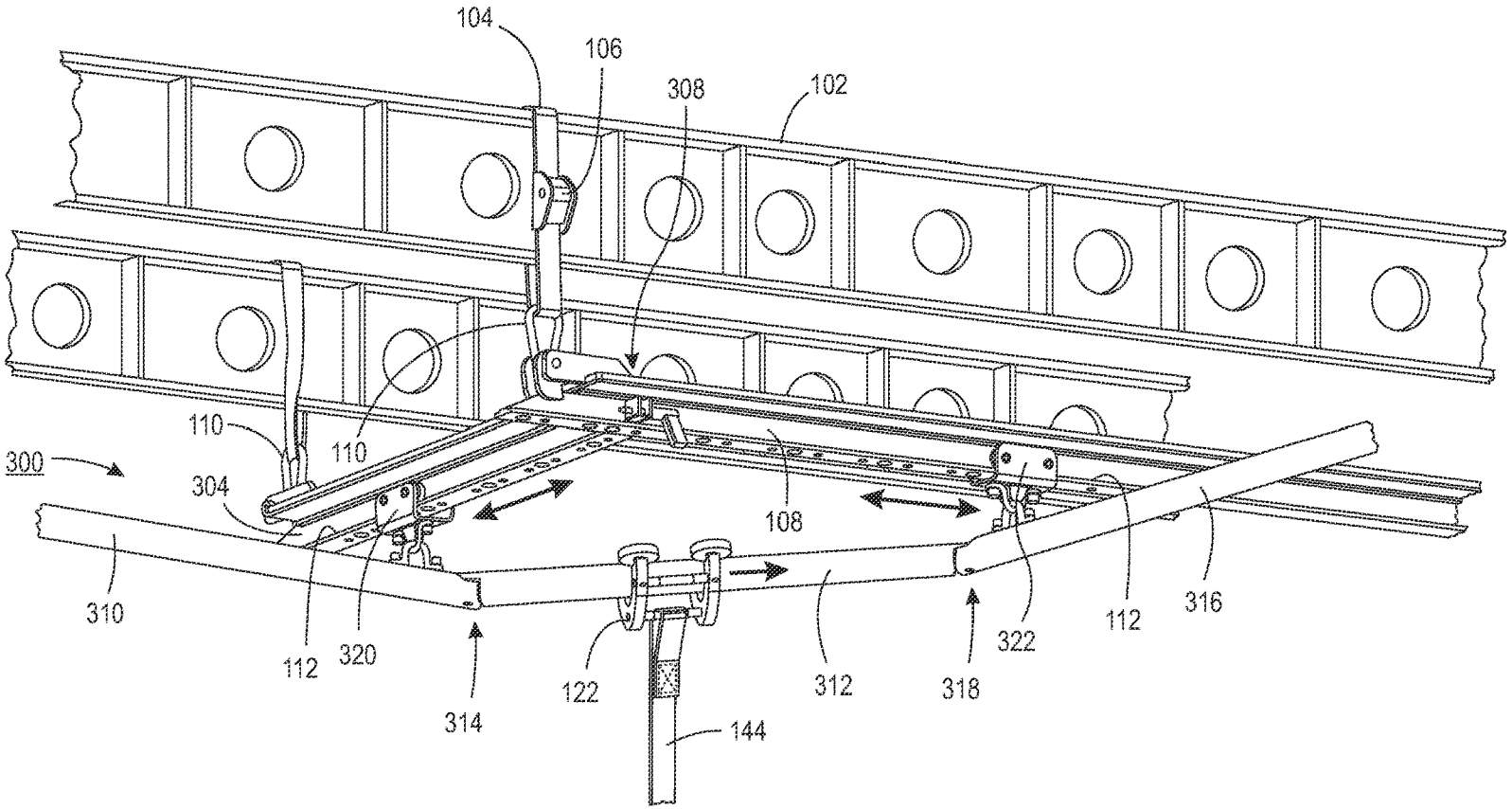
Figure 5:
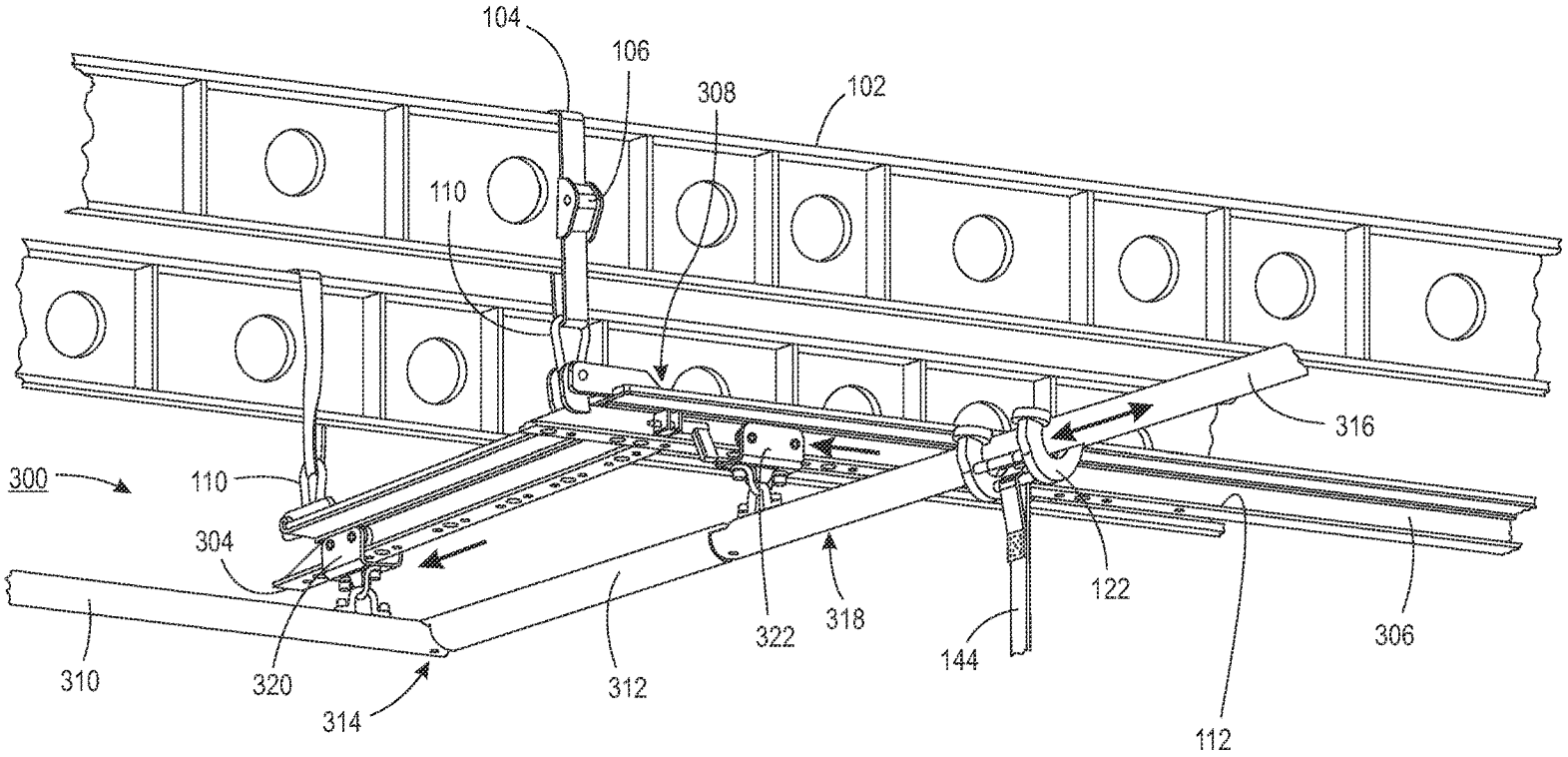

FIGS. 3-5 are perspective depictions of an articulated corner assembly 300 that allows a load to be moved around a bend. In this embodiment, the bend is a 90° corner that is encountered when moving a load from the first location to the second location. The corner assembly 300 may include an L-shaped corner track including a first track section 304 that intersects a second track section 306 at an angle, for example, an angle of about 90°. The first track section 304 is physically secured to the second track section 306 at a track intersection 308. The corner assembly 300 further includes a first rail section 310, a second rail section 312 attached to the first rail section 310 at a first joint 314, and a third rail section 316 attached to the second rail section 312 at a second joint 318. The corner assembly 300 further includes a first traveler 320 that movably attaches an end of the first rail section 310 to the first track section 304, and a second traveler 322 that movably attaches an end of the third rail section 316 to the second track section 306.

As depicted in FIGS. 3-5, the second rail section 312 has no traveler attached at either end, but is supported at a first end by the first rail section 310, and at a second end by the third rail section 316. Both ends of the second rail section 312 are positioned on top of an adjacent end of an adjacent rail section. In an embodiment, the first rail section 310 and second rail section 316 each have a traveler attached at only one end. Generally, at ends of rail sections that are unsupported by a traveler, the near end of the adjacent rail section will be supported by a traveler, and the near end of the adjacent rail section will be positioned underneath the unsupported rail section end.

In the FIG. 3 orientation, the trolley 122 having the power panel 140 (FIG. 6) attached with a strap 144 as described above, is rolled along the first rail section 310, from left to right in the depicted orientation. In the FIG. 3 state, the first traveler 320 is positioned near the intersection 308 of the first track section 304 and the second track section 306, while the second traveler 322 is positioned further away from the intersection 308 as depicted. For simplicity of description herein, the movement of each traveler 320, 322 is described with reference to a position A, where the traveler is arbitrarily close to the intersection 308, a position C, where the traveler is arbitrarily far away from the intersection 308, and a position B, where the traveler is at an intermediate distance from the intersection 308 and between positions A and C. During operation, the travelers may move continuously along the track section from position A, to position B, to position C, and back to position A through position B.

Thus in FIG. 3, the first traveler 320 is in position A and the second traveler 322 is in position C. Further, in the FIG. 3 orientation, the first rail section 310 is in line with the second rail section 312 at the first joint 314, and the first rail section 310 is straight (i.e., forms a straight rail) with the second rail section 312. Moreover, the second rail section 312 forms a 90° angle with the third rail section 316 at the second joint 318.

During use of the corner assembly 300, the trolley 122 of FIG. 3 may be rolled from the first rail section 310, across the first joint 314, and onto the second rail section 312. Subsequently, the rail sections 310, 312, 316 are articulated at the joints 314, 316 to the position depicted in FIG. 4. For example, the first rail section 310 and the second rail section 312 may articulate at the first joint 314 to form a 45° angle with each other. Further, the second rail section 312 and the third rail section 316 may articulate at the second joint 318 to form a 45° angle with each other. During the articulation of the rail sections 310, 312, 316, the first traveler 320 rolls along the first track section 304 from position A close to the intersection 308 to position B as depicted in FIG. 4 that is further away from the intersection 308 than position A. Additionally, during the articulation of the rail sections 310, 312, 316, the second traveler 322 rolls along the second track section 306 from position C as depicted in FIG. 3 that is away from the intersection 308 to position B as depicted in FIG. 4 that is closer to the intersection 308 than position C. When the corner assembly is in the FIG. 4 state, the first traveler 320 and the second traveler 322 are both in position B, and approximately the same distance from the intersection 308.

After articulating the corner assembly 300 to the FIG. 4 state, the corner assembly 300 may be articulated to the FIG. 5 state. During the transition from the FIG. 4 state to the FIG. 5 state, the rail sections 310, 312, 316 are articulated at the joints 314, 316 as depicted in FIG. 5. For example, the first rail section 310 and the second rail section 312 may articulate at the first joint 314 from the 45° angle of FIG. 4 to the 90° angle of FIG. 5. Further, the second rail section 312 and the third rail section 316 may articulate at the second joint 318 to be straight (i.e., for a straight rail) with each other. During the articulation of the rail sections 310, 312, 316, from the FIG. 4 state to the FIG. 5 state, the first traveler 320 rolls along the first track 304 from position B to position C. Additionally, during the articulation of the rail sections 310, 312, 316, the second traveler 322 rolls along the second track 306 from position B to position C. When the corner assembly is in the FIG. 5 state, the second traveler 322 is positioned near the intersection 308 of the first track section 304 in position A, while the first traveler 320 is positioned further away from the intersection 308 in position C as depicted.

Subsequently, the trolley 122 may be rolled from the second rail section 312 onto the third rail section 316 to complete the movement of the power panel 140 around the 90° corner as depicted in FIG. 5.

It will be appreciated that the corner assembly 300 of FIGS. 3-5 can allow for the movement of the load 140 through angles different than 90°, either greater or less than 90°. Further, the straight track section 108 of FIG. 1 may be a first track section that is used to support a section of rail 120 and some allow side-to-side movement of the attached rail section 120 and the load 140 during movement of a load 140 through an airframe. The corner assembly 300 of FIGS. 3-5 may include two intersecting track sections 304, 306 that allow movement of the attached rail sections 310, 312, 316, and further allow movement of the load 140 through a corner or bend. A rail fixture 100 in accordance with an embodiment can include a plurality of straight track sections, a plurality of rail sections, and a plurality of corner assemblies.

Figure 6:
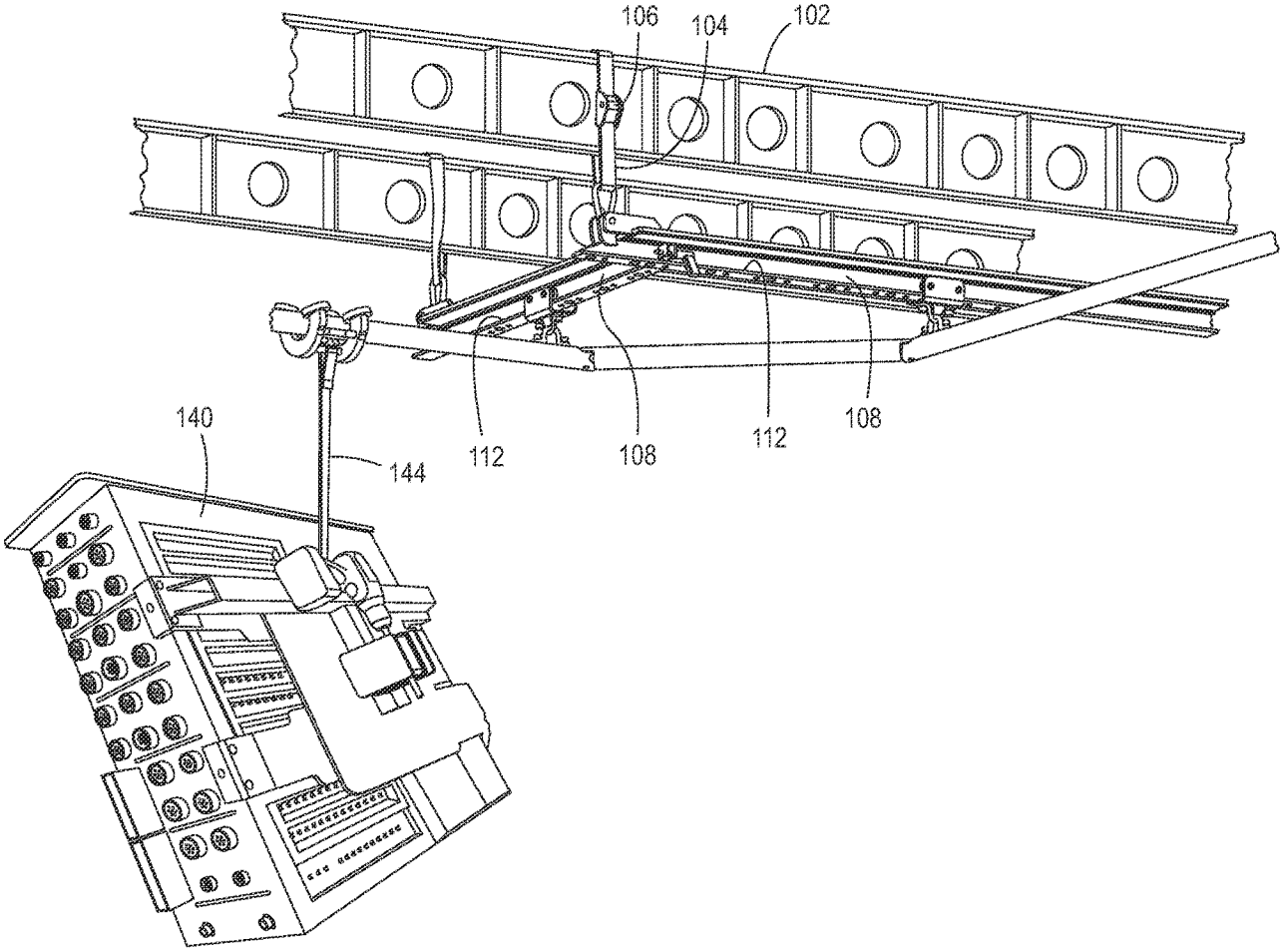

FIG. 6 is a perspective depiction a power panel 140 during transport from a first location to a second location using a corner assembly 300 as described above in reference to FIGS. 3-5. As depicted in FIG. 6, the joints between rail sections may articulate during transport of the load 140 from the first location to the second location, for example, to facilitate movement of the load 140 around and between objects or structures in or near the load travel path. Articulation of the joints moves the rail sections 120 in a lateral direction, thereby moving the trolley 122, as well as the load 140, in a lateral direction. Further, the load 140 may be rotated on the flexible strap 144 to further maneuver the load 140 around and between objects or structures in or near the load travel path.

Figure 7:
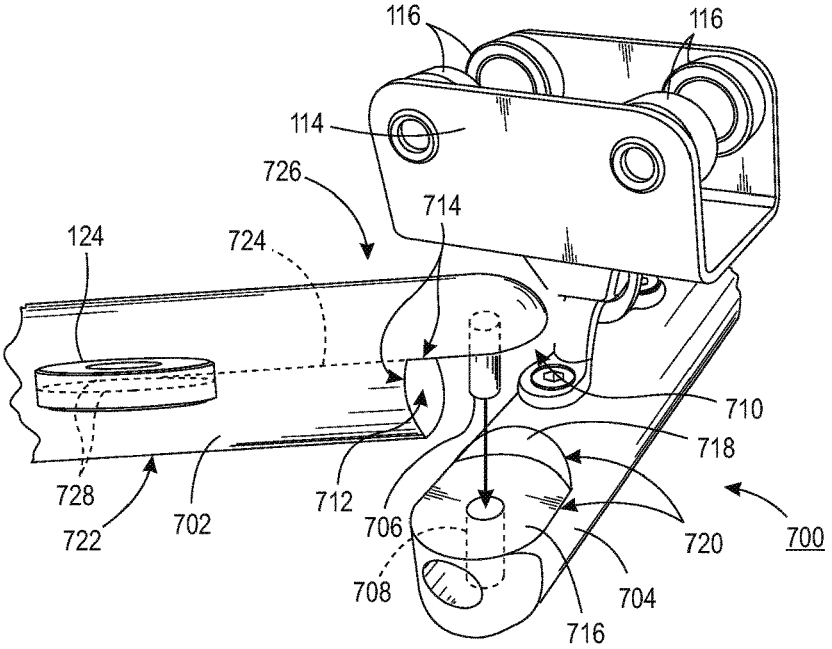
FIGS. 7 and 8 are perspective depictions of articulating joints between two rail sections and a trolley wheel positioned on a rail section in accordance with embodiments of the present teachings.

FIG. 7 depicts a joint 700 between a first rail section 702 and a second rail section 704. A pin 706 may be permanently or removably attached to the first rail section 702 at an end of the first rail section 702. The pin 706 is inserted into a hole 708 in the second rail section 704 at an end of the second rail section 704. Each rail section may have a pin 706 at a first end and a hole 708 at a second end. The joint 700 allows the rail sections to swivel or pivot with respect to each other such that the rail sections 702, 704 can form a varying angle during transport of the load 140.

In FIG. 7, the depicted end of second rail section 704 has the traveler 114 attached thereto, and the depicted end of second rail section 704 has the hole 708 that receives the pin 706 that is inserted into the hole 708 from the top of second rail section 704. The depicted end of first rail section 702 does not include a traveler 114 attached thereto, and the pin 706 at the end of first rail section 702 is inserted into the hole 708 from the top of second rail section 704. While positioned on the depicted end of first rail section 702, the load 140 is supported for a period of time mostly by the traveler 114 attached to second rail section 704. The opposite, non-depicted end of first rail section 702 may include a traveler 114 attached thereto, unless first rail section 702 is a middle rail 312 of a corner assembly 300 as described above. In use, a load 140 may be transferred either from the first rail section 702 onto the second rail section 704, or from the second rail section 704 onto the first rail section 702, depending on the direction of travel.

Figure 9:
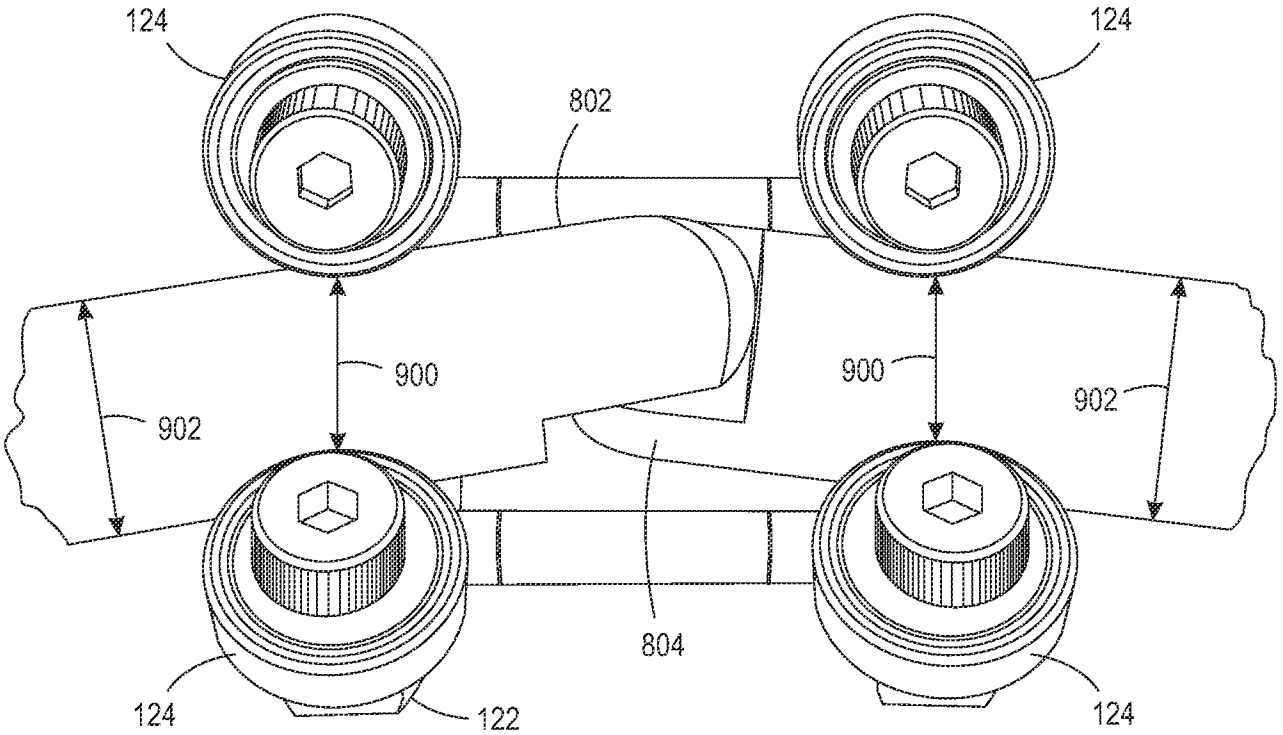
FIG. 9 is a perspective depiction of a trolley on an articulating joint between two rail sections in accordance with an embodiment of the present teachings.

During use of the rail fixture 100, the wheels 124 of the trolley 122 physically contact an upper half of the first rail section 702 and the second rail section 704. To maintain the trolley 122 on the rail sections 702, 704 during transfer of the load 104 across the rail sections of the rail fixture 100, a lateral spacing 900 (FIG. 9) of, or distance between, the wheels 124 of the trolley 122 is less than a diameter 902 (FIG. 9) of the rail sections. Each wheel 124 may be angled with respect to the rail sections 702, 704 so that weight from the load 140 is distributed across a width of each wheel 124 rather than toward either the upper or lower edge of the wheel 124. To initially position the trolley 122, the trolley is rolled onto an open end of the first rail section. The trolley 122 thus supports the load 140 through physical contact with an upper half of each rail section 702, 704.

During transfer of the load 140 across the plurality of rail sections 702, 704, bumping and jarring of the load 140 is to be avoided, which could occur as the trolley 122 passes across the joint 700 between the first rail section 702 and the second rail section 704. However, the ends of the rail sections 702, 704 and the operation of the trolley 122 may be configured as described herein to reduce jarring of the trolley 122, and thus to reduce jarring of the load 140 as the trolley 122 passes across the joint 700. For example, as shown in FIG. 7, the depicted end of first rail section 702 includes a horizontal surface 710 that intersects a convex surface 712, and an edge 714 where the horizontal surface 710 and the convex surface 712 intersect the rounded or circular exterior of the first rail section 702. Further, the depicted end of second rail section 704 includes a horizontal surface 716 that intersects a concave surface 718, and an edge 720 where the horizontal surface 716 and the convex surface 718 intersect the rounded or circular exterior of the second rail section 704. During use of the rail fixture 100, the convex surface 712 of the first rail section 702 is positioned close to the concave surface 718 of the second rail section 704, and the horizontal surfaces 710, 716 face each other, thereby forming a seam at the joint 700 at an interface between the two rail sections. The seam is generally depicted and positioned at the interface between edges 714 and 720. The pin 706 may pivot within the hole 708 to allow the first rail section 702 to rotate with respect to the second rail section 704.

As depicted in FIG. 7, the first rail section 702 is formed so that a first distance from a bottom 722 of the first rail section 702 to the horizontal surface 710 (and, similarly, to a plane 724 of the horizontal surface 710 that extends through the first rail section 702) is greater than a second distance from a top 726 of the first rail section 702 to the horizontal surface 710 (and, similarly, to a plane 724 of the horizontal surface 710 that extends through the first rail section 702). In an embodiment, the first distance from the bottom 722 to the plane 724 of the horizontal surface 710 may range from about 60% to about 90% of the overall thickness from the bottom 722 to the top 726, or from about 65% to about 85%, or from about 70% to about 80%. It will be appreciated that the second rail section 704 is similarly designed, and some or all other rail sections of the rail fixture 100 may be similarly designed. With the horizontal surface 710 being designed above a centerline of the first rail section 702, a centerline 728 of a width of each wheel 124 of the trolley 122 rolls across the edge 714 of the horizontal surface 710, and thus across the seam between edges 714 and 720. With the centerline 728 of the wheel over edge 714 of the horizontal surface 710, jarring of the trolley 122 as it rolls across the joint 700 may be reduced, compared to some other configurations.

Additionally, in FIG. 7, the edge 714 of the convex surface 712 and the edge 720 of the concave surface 718 are curved. In this embodiment, as the wheel 124 rolls across the joint 700, these edges 714, 720 provide a gradual transition of the wheel across the seam between the surfaces of the first rail section 702 and the second rail section 704. In other words, with the surfaces as depicted in FIG. 7 and the centerline 128 of the wheel rolling over the edge 714 of the horizontal surface 710, half of the width of the wheel 124 does not roll across the seam between convex 712 and concave 718 surfaces at the same time, but gradually transitions across the seam.

Figure 8:
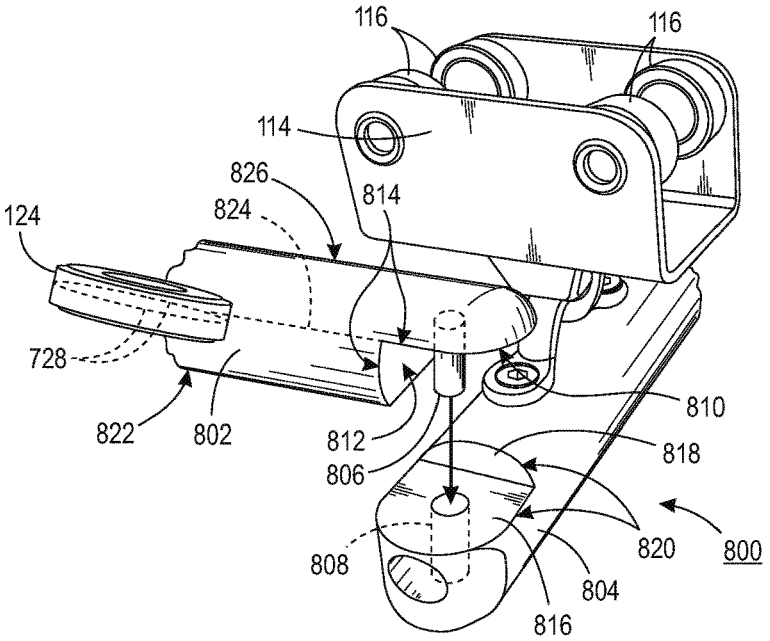

With the embodiment of FIG. 7, the first rail section 702 may not be operable to rotate a full 180° with respect to the second rail section 704 (i.e., 90° to the left and 90° to the right). This may result from physical contact between surface 712 and 718 at edges 714 and 720. FIG. 8 depicts an embodiment where a surface 812 of a first rail section 802 and a surface 818 of a second rail section 804 are flat or planar across their respective surfaces, such that the first rail section 802 is operable to rotate a full 180° with respect to the second rail section 804 (i.e., 90° to the left and 90° to the right). In this embodiment, it will be appreciated that the wheel 124 of the trolley 122 encounters the edge 814 of the flat surface 812, and the seam between edges 814 and 820, across the entire lower half of the wheel 124 at the same time. However, in this embodiment, the first rail section 802 may rotate a full 180° with respect to the second rail section 804.

In either of the embodiments of FIGS. 7 and 8, a seam, distance, or gap between surfaces 712 and 718 (FIG. 7) and between surfaces 812 and 818 (FIG. 8) may be kept to a minimum to reduce jarring of the load 140 as it transitions across the joint 700 at the interface of first rail section 702 and 704 of FIG. 7, and across the joint 800 at the interface of rail section 802 and 804 of FIG. 8. The "800" reference numbers and structures in FIG. 8 are analogous to the "700" reference numbers and structures in FIG. 7.

Figure 10:
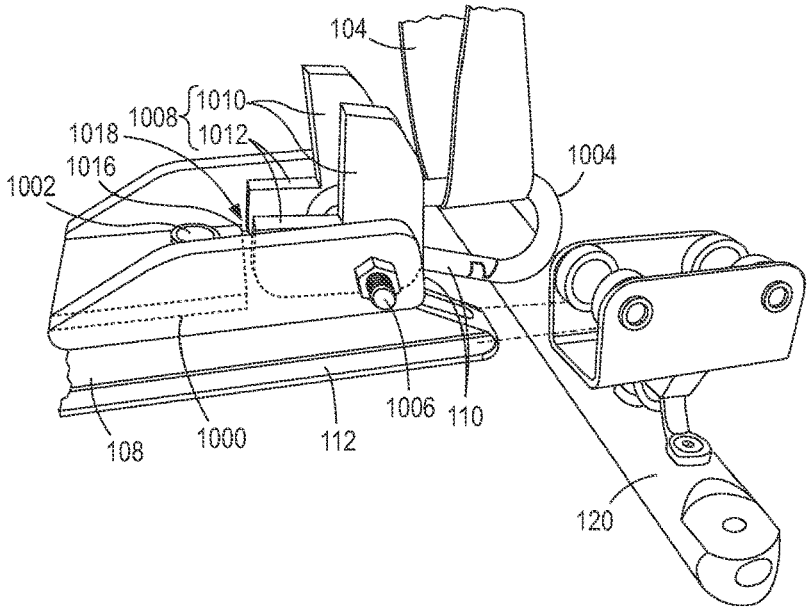
FIGS. 10 and 11 are perspective depictions of a stopper integrated with a track hanger in accordance with an embodiment of the present teachings.
Figure 11:
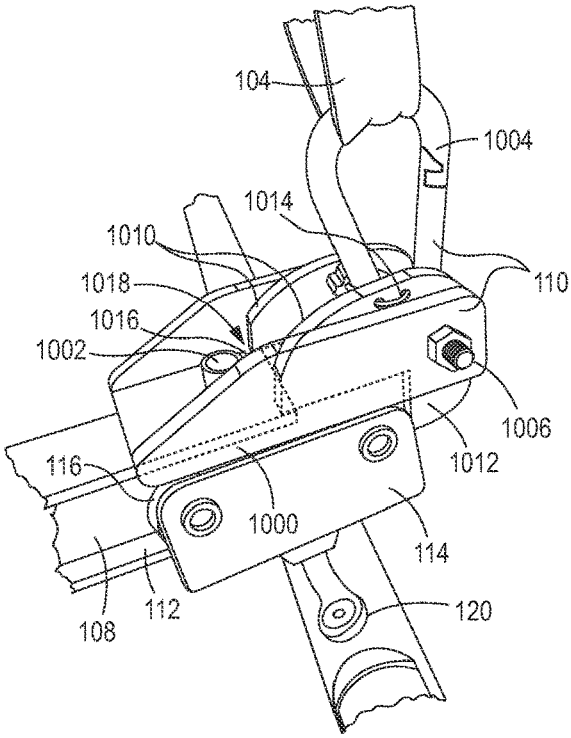

As depicted in FIGS. 10 and 11, after hanging the track section 108, the wheels 116 of a traveler 114 that is attached to a rail section 120 may be placed onto the shelves 112 of a track section 108 during assembly of the rail fixture 100 within the interior of an airframe 102 or other structure. The track section 108 may be suspended from the airframe 102 (FIG. 1) with a track hanger 110 that, in this embodiment, includes a hanger frame 1000 affixed to a top surface of the track section 108 with a fastener 1002 such as a bolt. The hanger 110 further includes a carabiner 1004. A strap 104 extends through the carabiner 1004 and over the airframe 102. A fastener 1006 such as a bolt may extend through holes in the frame 1000 and through an opening in the carabiner 1004 to secure the carabiner 1004 to the hanger frame 1000.

To prevent the traveler 114 from inadvertently rolling off of the track section 108 during transport of the load 140, the rail fixture 100 may include a stopper 170 as described above with reference to FIGS. 1 and 2. FIGS. 10 and 11 depict a stopper that is integrated with the track hanger 110. The stopper may include at least one stopper plate 1008, such as at least one "L" shaped stopper plate 1008, having a first leg 1010 and a second leg 1012. The embodiment of FIGS. 10 and 11 depict a stopper having two stopper plates 1008. The plates 1008 may be rotatably affixed to the carabiner 1004 using, for example, one or more wires 1014 through holes in the plates 1008. Other assemblies that permit the rotation of the plates 1008 with the carabiner 1004 are contemplated.

FIG. 11 depicts the hanger 110 and the stopper 170 in an open position. In this embodiment, the track section 108 may be lifted slightly and the carabiner 1004 is rotated to a horizontal position in line with the track section 108, which rotates the stopper 170 and, more particularly, the plates 1008 to the open position. In the open position, the first legs 1010 are positioned vertically and are oriented perpendicularly to a longitudinal axis of the track section 108 as depicted in FIG. 11. Also in the open position, the second legs 1012 are positioned horizontally and are oriented parallel to the longitudinal axis of the track section 108 as depicted in FIG. 11. In the open position, the shelves 112 of the track section 108 are exposed and unblocked. The wheels 116 of the traveler 114 may be placed on the shelves 112, and the traveler 114 may be rolled past the hanger 110 and the plates 1008 toward the center of the track section 108.

Figure 12:
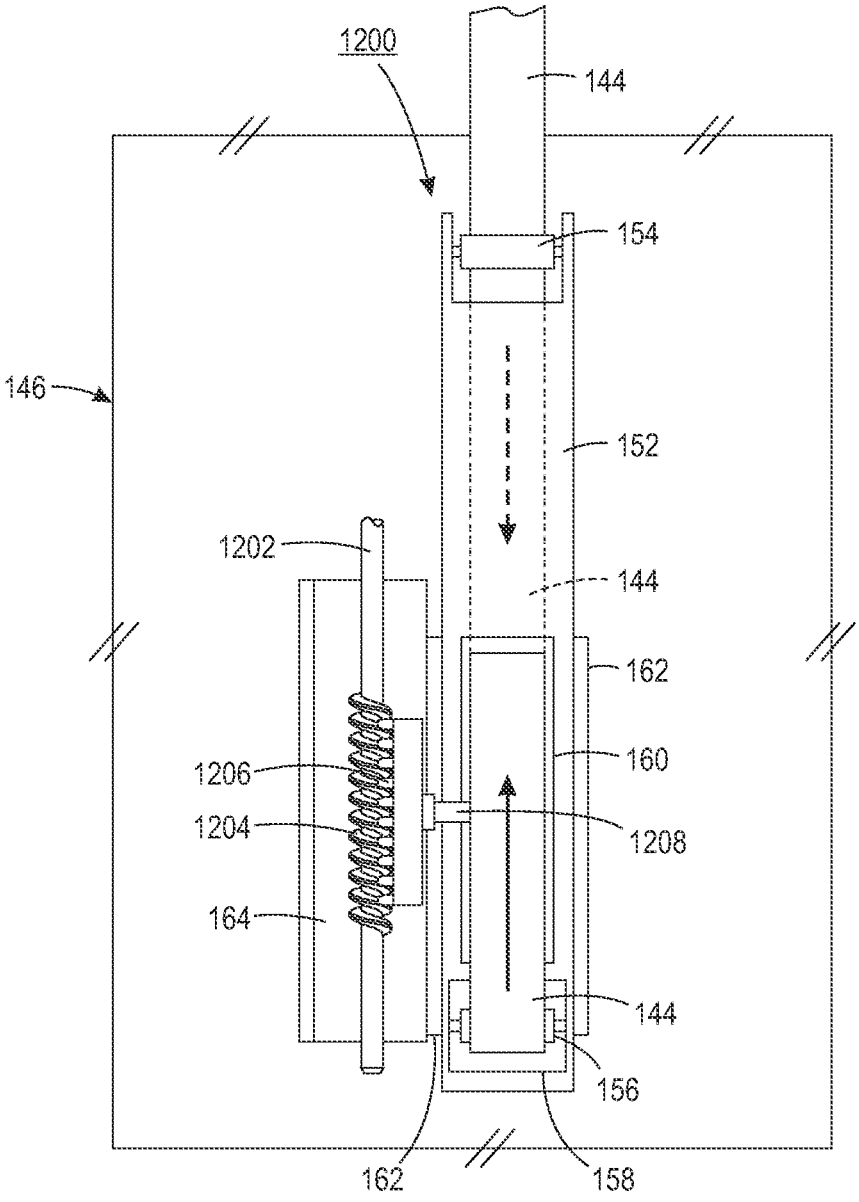
FIG. 12 is a plan view depicting detail of a winch assembly that may be used to lift and suspend a load from a rail fixture or other structure in accordance with an embodiment of the present teachings.

After placing the traveler onto the track section 108, the track section 108 is lowered which, through gravity or manual rotation, rotates the carabiner 110 into the closed position as depicted in FIG. 12. In the closed position, the carabiner 1004 is rotated to a vertical position perpendicular to the track section 108, which rotates the stopper 170 to the closed position. In the closed position, the first legs 1010 of the plates 1008 are positioned horizontally and are oriented parallel to a longitudinal axis of the track section 108 as depicted in FIG. 12. Also in the closed position, the second legs 1012 of the plates 1008 are positioned vertically and are oriented perpendicular to the longitudinal axis of the track section 108 as depicted in FIG. 11. In the closed position, the shelves 112 of the track section 108 are blocked by the second legs 1012. If the traveler 114 rolls from the middle of the track section 108 toward the end of the track section 108, the second legs 1012 of the stopper 170 stop the movement and block the traveler 114.

In this embodiment, the second legs 1012 are shorter than the first legs 1010. When the stopper 170 is placed into the open position as depicted in FIG. 10, the second legs 1012 are able to extend past a lip 1016 of the hanger frame 1000 and rotate into and through an opening 1018 in the hanger frame 1000. When the stopper is placed into the closed position of FIG. 11, the second legs 1012 rotate past the lip 1016, out of the opening 1018 in the hanger frame 1000, and block the travel path of the traveler 114, but the longer first legs 1010 physically contact the lip 1016 to prevent over rotation of the stopper 170, specifically, the plates 1008. Over rotation of the plates 1008 would allow the traveler 114 to extend past the hanger 110 and off of the track section 108. Thus the stopper 170 integrated with the track hanger 110 as described herein may provide an automatic mechanical stopper 170 that prevents the traveler 114 from falling off of the track section 108 during transport of a load 140, and thus prevents injury to assembly personnel and damage to the load or other structures from mishandling of the load 140.

FIG. 12 is a schematic plan view depicting additional detail of a portion of the winch assembly 146 as described above with reference to FIGS. 1 and 2. FIG. 12 depicts a hollow tube 152 that attaches to a strongback 150, a first roller 154 attached to the tube 152 at a tube opening 1200 at the first end of the tube 152, a second roller 156 within an interior of the tube 152, and a slot 158 that extends through the wall of the tube 152 proximate the second roller 156. The winch assembly 146 can further include a take-up reel 160 that may be attached to the tube 152 by a frame 162, a gearbox 164 in mechanical communication with the take-up reel 160, and a motor 166 (FIGS. 1 and 2) in mechanical communication with the gearbox 164. In this embodiment, the motor 166 may be supplied by a battery-powered electric drill, although other DC or AC motors are contemplated. The motor 166 may be in mechanical communication with the gearbox 164 using a shaft 1202 that is rotated by the motor 166. In the FIG. 12 orientation, the shaft 1202 rotates in a horizontal direction, which rotates a first worm gear portion 1204 that may be formed as part of the shaft 1202 in a horizontal direction. Rotation of the first worm gear portion 1204 rotates a second worm gear portion 1206 that is attached to an axle 1208 of the take-up reel 160, thereby rotating the take-up reel 160. Depending on the direction of travel, rotating the take-up reel 160 will either spool the strap 144 onto the take-up reel 160, thereby lifting the load 140, or unspooling the strap 144 from the take-up reel 160, thereby lower the load 140.

It will be understood that the description and depiction of the winch assembly 146 is simplified for purposes of explanation. For example, the gearbox 164 will likely include many additional gears of differing gear ratios, for example, to increase the torque applied to the take-up reel by the motor to enable a relatively low torque motor 166 such as a battery powered electric drill to lift a relatively heavy load 140 such as a power panel, as well as the durability and longevity of the gearbox 164. In an embodiment, the gear box may have a gear ratio in the range of from 30:1 to 120:1, for example, 60:1. Worm gearboxes having a sufficient gear ratio are available from Ondrive. US Corp. of Freeport, New York, for example, model P45-60.

Figure 13:
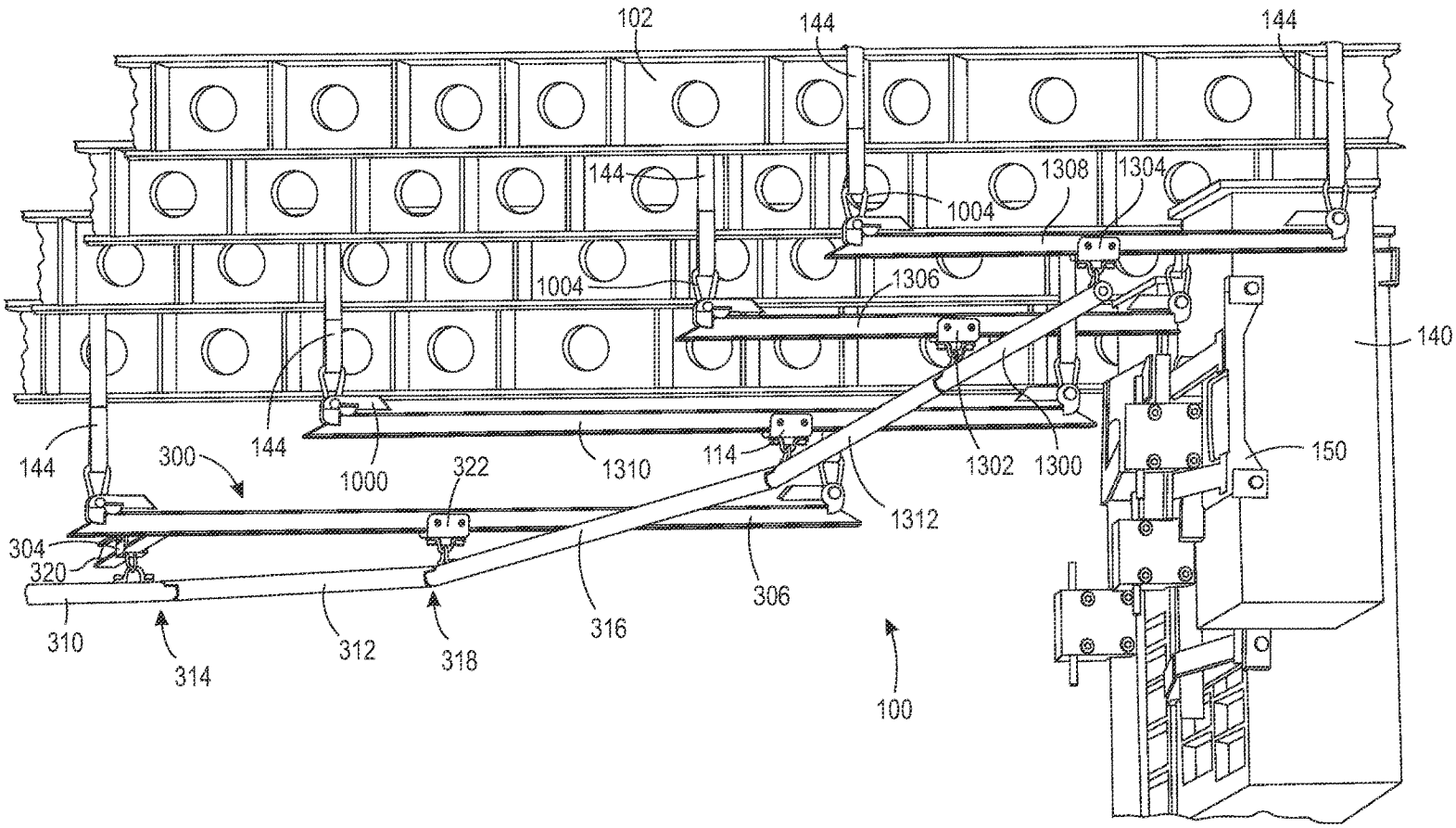
FIG. 13 is a perspective depiction of a portion of a rail fixture in accordance with an embodiment of the present teachings.

FIG. 13 is a perspective depiction of a rail fixture 100 after the load 140 such as a power panel has been transported and delivered to, and installed in, its final location. FIG. 13 depicts a corner assembly 300 and other structures as described above. During assembly of the rail fixture 100, the end track section and end rail section (i.e., the track section and rail section at the second location where the load 140 is being transported to) will typically be installed first, and then each track section and rail section will be installed in turn from the second location to the first location. The end rail section 1300 may be attached at first end to a first traveler 1302 and at a second end to a second traveler 1304. In general, the end rail section 1300 may be installed first and may therefore be directly attached to two separate travelers with one traveler at each end. Other rail sections between the end rail section 1300 at the second location the beginning rail section may have only one traveler 114 attached thereto (see, for example, rail sections 316 and 1312) or, in the case of the middle rail 312 of a corner assembly 300, no travelers directly attached. The beginning rail section may have one or two attached travelers. For example, if rail section 310 is the beginning rail section, rail section 310 would have two travelers attached, one at joint 314 and one at the opposite end of rail 310 to support the end. If the beginning rail section at the first location is configured similar to depicted rail section 316, the beginning rail section would have only one traveler attached.

To install the rail fixture 100, a first track section 1306 and a second track section 1308 are suspended from the airframe 102 as described above. Next, the first traveler 1302 is positioned on the first track section 1306, and the second traveler 1304 is positioned on the second track section 1308, as described above. Subsequently, one or more additional track sections 1310 are suspended from the airframe 102, and one or more rail sections 1312 are attached to the track sections 1310. As described above, rail sections 1312 may include a traveler 114 at one end, and no traveler at the opposite end. The end attached to the traveler 114 will be positioned underneath the adjacent rail section end with no traveler, while the end with no traveler 114 will be positioned over an adjacent rail section end having a traveler 114 attached thereto.

In the exemplary depiction of FIG. 13, the end rail section 1300 at the second location includes travelers 1302, 1304 at both ends. The end of rail section 1300 attached to traveler 1302 is positioned underneath, and therefore supports, the end of adjacent rail section 1312. The opposite end of rail section 1312 is attached to a traveler 114, and is positioned underneath, and therefore supports, the end of adjacent rail section 316, which is part of corner assembly 300. Rail section 312 of corner assembly 300 has no traveler attached at either end, so both ends of rail section 312 are positioned over, and supported by, the ends of adjacent rail sections 310 and 316. Rail section 310 has a traveler 320 attached thereto at joint 314, but may have no traveler attached at the other non-depicted end if an adjacent rail section includes a traveler, or may include a traveler if rail section 310 is the positioned at the starting location (i.e., the first location).

Thus the rail sections 1312, 316 leading away from end rail section 1300 have an end closest to end rail section 1300 with no traveler, and an end furthest away from end rail section 1300 with a traveler. Continuing down the rail fixture 100 away from end rail section 1300, once an unsupported middle rail section 312 of a corner assembly 300 is encountered, the end of the next rail section 310 closest to the end rail section 1300 has a traveler attached thereto. Thus rail section 310 leading away from end rail section 1300 has an end closest to end rail section 1300 with a traveler, and may have an end furthest away from end rail section 1300 with no traveler, unless rail section 310 is part of a second corner assembly 300 or is an end section at the first location, in which case it may have a traveler attached at both ends similar to end rail section 1300.

As depicted, some track sections 1306, 1308 may be shorter than other track sections 1310, 306 and some rail section 312 may be shorter than other rail sections 316. After installing all track sections, rail sections, and corner assemblies, the trolley 122 may be positioned on the first rail section, the load 144 may be attached to the trolley 122 and lifted into position suspended from the trolley 122, for example, using the winch assembly 146, and then moved from an initial starting first location to an ending second location at end section 1300, where it is then installed in its final location.

The materials used to manufacture each of the components of the rail fixture 100 and the dimensions of each component depend, for example, on the stresses encountered during transport of the load 140 which, in turn, depends on the anticipated weight of the load. The system may be designed to support and transport a load having an anticipated weight, plus any additional tolerance. Various materials may be used in the manufacture of the rail fixture, for example, steel, aluminum, iron, metal alloys, synthetic materials such as polymers, etc. A sufficient rail system in accordance with an embodiment of the present teachings may be designed and manufactured by one of ordinary skill in the art from the description herein.

The rail fixture described herein thus provides a system that may be used to support and move a relatively heavy object through a relatively confined or tight space such as an aircraft airframe across long span distances. The rail fixture is relatively quick to install, disassembly, and remove from the assembly location without undue time or effort. The plurality of travelers 114 and movable hangers 104, 118, 144 allow lateral and omnidirectional movement of the rail sections 120 during movement of the load 140 from a first location to a second location, and around corners such as 90° bends. The articulating rails can be adjusted during load movement, and can articulate or snake around obstacles, which straight rails or a fixed system cannot. The rail system may be suspended without using struts and may hang from existing structures. The winch assembly 146 allows the load 140 to be lifted using a motor. The rail fixture may thus reduce injury to assembly personnel as well as damage to the airframe and power panel, and may further reduce assembly costs. All rail sections may be straight and are not curved, but the load may still be moved in curved directions. The articulating round rails are connected in such a way that the loaded trolley transfers between rail sections with little or no bump, divot or obstruction. With the winch assembly described herein, the motor and winch are physically located on the weight that is being lifted, which improves control of the load. The space required for the motor, the winch, and the load is consolidated so the load can be lifted higher that a system which uses a crane or other winch system. Further, a single operator can manipulate the load while operating the lift motor.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A rail fixture, comprising:

a plurality of rail sections comprising a first rail section, a second rail section, and at least a third rail section;

at least two rail hangers configured to suspend the plurality of rail sections from a rail support structure; and at least one trolley comprising at least three roller wheels and a load support configured to support a load to be moved using the rail fixture, wherein:

the trolley is configured to traverse the plurality of rail sections;

the first rail section and the second rail section are connected together and configured to articulate with each other while the first rail section and the second rail section remain connected together, and are further configured to form a varying first angle with each other during support of the load and movement of the load to be moved while the first rail section and the second rail section remain connected together; and the second rail section and the third rail section are connected together and configured to articulate with each other while the second rail section remains connected to the first rail section and to the third rail section, and are further configured to form a varying second angle with each other during support of the load and movement of the load to be moved while the second rail section remains connected to the first rail section and to the third rail section.

2. The rail fixture of claim 1, further comprising:

a first articulating joint connecting the first rail section and the second rail section together, and a first seam at an interface of the first rail section and the second rail section at the first articulating joint; and a second articulating joint connecting the second rail section and the third rail section together, and a second seam at an interface of the second rail section and the third rail section at the second articulating joint, wherein a centerline of each roller wheel is configured to roll across the first seam and the second seam.

3. The rail fixture of claim 1, wherein the first rail section and the second rail section are configured such that:

the varying first angle decreases during an increase in the varying second angle; and the varying first angle increases during a decrease in the varying second angle.

4. The rail fixture of claim 1, further comprising:

at least one track section; and at least two travelers attached to the at least two rail hangers, wherein the at least two travelers are configured to traverse the at least one track section as the first rail section and the second rail section articulate with each other and as the second rail section and the third rail section articulate with each other.

5. The rail fixture of claim 4, further comprising:

each rail hanger further comprises a hanger frame having an opening therein and a carabiner rotatably attached to the hanger frame; and at least one stopper plate comprising a first leg and a second leg, wherein:

the second leg is shorter than the first leg;

the stopper plate is rotatably attached to the carabiner;

the stopper comprises a first position that allows at least one of the travelers to be positioned on one of the track sections; and the stopper comprises a second position that blocks one of the track sections to prevent at least one of the travelers from extending past an end of the track section.

6. The rail fixture of claim 4, wherein:

the track section comprises a first lip and a second lip; and each traveler comprises a first set of wheels that engage the first lip during movement of the load to be moved and a second set of wheels that engage the second lip during movement of the load to be moved.

7. The rail fixture of claim 6, wherein the at least one trolley is configured to engage at least the second rail section as the first rail section and the second rail section articulate with each other and as the second rail section and the third rail section articulate with each other.

8. The rail fixture of claim 1, further comprising:

a first pin that connects the first rail section and the second rail section together, wherein the first rail section and the second rail section are configured to articulate by swiveling on the first pin; and a second pin that connects the second rail section and the third rail section together, wherein the second rail section and the third rail section are configured to articulate by swiveling on the second pin.

9. The rail fixture of claim 1, further comprising:

a strap attached to the load support; and a motor attached to the strap, wherein:

the strap is configured to be attached to a load to be moved; and the motor is configured move along the strap to lift the load to be moved during operation of the motor.

10. The rail fixture of claim 9, further comprising a load to be moved attached to the strap, wherein the rail fixture is configured to lift the load toward the plurality of rail sections during operation of the motor.

11. A rail fixture, comprising:

a corner assembly, comprising:

a first track section and a second track section, wherein the first track section intersects the second track section at an intersection;

a first traveler configured to traverse the first track section and a second traveler configured to traverse the second track section; and a first rail section connected to the first traveler by a first rail hanger, a second rail section connected at a first articulating joint to the first rail section, and a third rail section connected to the second rail section at a second articulating joint and further connected to the second traveler by a second rail hanger; and a trolley configured to traverse the first rail section, the second rail section, and the third rail section, wherein:

the first rail section and the second rail section are configured to articulate with each other at the first articulating joint while the first rail section and the second rail section remain connected together; and the second rail section and the third rail section are configured to articulate with each other at the second joint while the second rail section remains connected to the first rail section at the first articulating joint and while the second rail section remains connected to the third rail section at the second articulating joint.

12. The rail fixture of claim 11, wherein:

the first traveler is configured to be in a first position near the intersection when the first rail section is straight with the second rail section, and when the second rail section forms a 90° angle with the third rail section;

the second traveler is configured to be in a second position away from the intersection when the first rail section is straight with the second rail section, and when the second rail section forms a 90° angle with the third rail section, where the second position is further away from the intersection than the first position;

the first traveler is configured to be in a third position away the intersection when the first rail section forms a 90° angle with the second rail section, and when the second rail section is straight with the third rail section; and the second traveler is configured to be in a fourth position near the intersection when the first rail section forms a 90° angle with the second rail section, and when the second rail section is straight with the third rail section, where the fourth position is closer to the intersection than the third position.

13. The rail fixture of claim 12, wherein:

the first rail section and the second rail section are attached at the first articulating joint, and the first articulating joint is configured such that the first rail section can swivel on the second rail section; and the second rail section and the third rail section are attached at the second articulating joint, and the second articulating joint is configured such that the second rail section can swivel on the third rail section.

14. A rail fixture, comprising:

a plurality of rail sections comprising a first rail section, a second rail section, and at least a third rail section;

at least two rail hangers configured to suspend the plurality of rail sections from a rail support structure, wherein each rail hanger further comprises a hanger frame having an opening therein and a carabiner rotatably attached to the hanger frame;

at least one track section;

at least one stopper plate comprising a first leg and a second leg, wherein:

the second leg is shorter than the first leg;

the stopper plate is rotatably attached to the carabiner;

the stopper comprises a first position that allows at least one of the travelers to be positioned on one of the track sections; and the stopper comprises a second position that blocks one of the track sections to prevent at least one of the travelers from extending past an end of the track section;

at least two travelers attached to the at least two rail hangers;

at least one trolley comprising at least three roller wheels and a load support configured to support a load to be moved using the rail fixture, wherein:

the trolley is configured to traverse the plurality of rail sections;

the first rail section and the second rail section are connected together and configured to articulate with each other and to form a varying first angle during movement of the load to be moved;

the second rail section and the third rail section are connected together and configured to articulate with each other and to form a varying second angle during movement of the load to be moved; and the at least two travelers are configured to traverse the at least one track section as the first rail section and the second rail section articulate with each other and as the second rail section and the third rail section articulate with each other.

15. The rail fixture of claim 14, further comprising:

a first articulating joint connecting the first rail section and the second rail section together, and a first seam at an interface of the first rail section and the second rail section at the first articulating joint; and a second articulating joint connecting the second rail section and the third rail section together, and a second seam at an interface of the second rail section and the third rail section at the second articulating joint, wherein a centerline of each roller wheel is configured to roll across the first seam and the second seam.

16. The rail fixture of claim 14, wherein the first rail section and the second rail section are configured such that:

the varying first angle decreases during an increase in the varying second angle; and the varying first angle increases during a decrease in the varying second angle.

17. The rail fixture of claim 14, wherein:

the track section comprises a first lip and a second lip; and each traveler comprises a first set of wheels that engage the first lip during movement of the load to be moved and a second set of wheels that engage the second lip during movement of the load to be moved.

18. The rail fixture of claim 17, wherein the at least one trolley is configured to engage at least the second rail section as the first rail section and the second rail section articulate with each other and as the second rail section and the third rail section articulate with each other.

19. The rail fixture of claim 14, further comprising:

a first pin that connects the first rail section and the second rail section together, wherein the first rail section and the second rail section are configured to articulate by swiveling on the first pin; and a second pin that connects the second rail section and the third rail section together, wherein the second rail section and the third rail section are configured to articulate by swiveling on the second pin.

20. The rail fixture of claim 14, further comprising:

a strap attached to the load support; and a motor attached to the strap, wherein:

the strap is configured to be attached to a load to be moved; and the motor is configured move along the strap to lift the load to be moved during operation of the motor.

* * * * *